US006204065B1

(12) United States Patent
Ochiai

(10) Patent No.: US 6,204,065 B1
(45) Date of Patent: Mar. 20, 2001

(54) CONDUCTION ASSIST MEMBER AND MANUFACTURING METHOD OF THE SAME

(75) Inventor: Toshimasa Ochiai, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 0 days.

(21) Appl. No.: 09/047,102

(22) Filed: Mar. 24, 1998

(30) Foreign Application Priority Data

Mar. 27, 1997 (JP) ..... 9-076342

(51) Int. Cl.[7] ..... H01R 12/00; H01R 13/40; H05K 1/00

(52) U.S. Cl. ..... 436/66; 436/591

(58) Field of Search ..... 439/66, 71, 81, 439/91, 591

(56) References Cited

U.S. PATENT DOCUMENTS

| | | | | |
|---|---|---|---|---|
| 5,139,427 | * | 8/1992 | Boyd et al. | 439/66 |
| 5,152,695 | * | 10/1992 | Grabbe et al. | 439/71 |
| 5,173,055 | * | 12/1992 | Grabbe | 439/66 |
| 5,228,861 | * | 7/1993 | Grabbe | 439/66 |
| 5,324,205 | * | 6/1994 | Ahmad et al. | 439/66 |
| 5,395,252 | * | 3/1995 | White | 439/66 |
| 5,403,194 | * | 4/1995 | Yamazaki | 439/66 |
| 5,437,556 | * | 8/1995 | Bargain et al. | 439/66 |
| 5,588,845 | * | 12/1996 | Naitoh et al. | 439/66 |
| 5,800,184 | * | 9/1998 | Lopergolo et al. | 439/66 |
| 5,801,441 | * | 9/1998 | DiStefano et al. | 257/696 |
| 5,860,813 | * | 1/1999 | Irlbeck et al. | 439/67 |
| 5,975,959 | * | 11/1999 | Joly | 439/630 |

FOREIGN PATENT DOCUMENTS

| | | |
|---|---|---|
| 51-8710 | 3/1976 | (JP) . |
| 1-22230 | 6/1989 | (JP) . |

OTHER PUBLICATIONS

H. C. Schick, IBM Bulletin, vol. 6, No. 10, p. 5, Mar. 1964.*

* cited by examiner

*Primary Examiner*—Brian Sircus
*Assistant Examiner*—Chandrika Prasad
(74) *Attorney, Agent, or Firm*—Burr & Brown

(57) ABSTRACT

A conduction assist member has conductive members disposed in some or all through holes which are formed in a large number in a sheet made of an insulating elastic material. The conduction member is a cut piece which is fixed to the sheet at one end thereof and has two or more blades formed by one, two or more cuts. In the conduction assist member, one or some of the two or more blades formed on each cut piece, are bent toward one of two opening portions of the through hole so that ends of the blades formed on the cut pieces protrude from the opening portion on the same surface of the sheet. The conduction assist member can be applied as a connector to both a flat conduction surface and a curved conduction surface, and as an integrated circuit socket which can easily cope with differences in sizes of connectors and sockets, which is superior in high speed performance and usable as an integrated circuit socket for mounting, and which can easily be assembled.

11 Claims, 5 Drawing Sheets

CONDUCTION ASSIST MEMBER AND MANUFACTURING METHOD OF THE SAME

BACKGROUND OF THE INVENTION AND RELATED ART STATEMENT

The present invention relates to a conduction assist member used for connection between conductors for various electronic equipments, manufacturing method of the same, a connector using the same and an integrated circuit socket using the same.

A conduction assist member functions to assist electrical conduction between connecting elements of a connector by being made to intervene between the connecting elements.

There are several types of connector electrically connecting conductors to each other. For example, in one type of connector, connecting elements have flat conductive surfaces. They are laid one on top of the other and brought into contact with each other so that electrical conduction is made. In another type of connector, one of connecting elements is a plug and the other is a socket, and the plug is fitted in the socket to bring an outer circumferential surface of the plug into contact with an inner circumferential of a socket hole so that the electrical conduction is made. In order to secure sufficient electrical connection in such a connector, it is necessary to bring the connecting elements into close contact with each other. However, if the connecting element has a distortion, or dust or the like exists between the connecting elements, the contact area between the connecting elements becomes small. As a result, close contact between the connecting elements is prevented and electrical connection becomes incomplete.

As a means for solving the above-mentioned problem, Japanese Utility Model Publication (Kokoku) No. 1-22230 discloses a conduction assist member in which a plurality of blades are disposed between two annular frames with a constant interval and obliquely oriented with respect to an outer circumferential surface of a plug, the conduction assist member being disposed around an inner circumferential surface of a socket hole or the outer circumferential surface of the plug. Japanese Utility Model Publication (Kokoku) No. 51-8710 discloses a conduction assist member in which tongue pieces both ends of which are connected to an annular metal band provided with a plurality of cuts, are disposed around an inner circumferential surface of a socket hole or an outer circumferential surface of a plug so that the tongue pieces are obliquely oriented with respect to the outer circumferential surface of the plug.

On the other hand, an integrated circuit such as an IC or an LSI is mounted on a substrate or the like through an integrated circuit socket. Thus, in order to secure sufficient electrical conduction, it is necessary that a contact substrate of the integrated circuit socket, that is, a portion assisting conduction between the integrated circuit and the substrate, is brought into close contact with both of a terminal of the integrated circuit and a terminal formed in the substrate. Further, the contact substrate of the integrated circuit socket used for mounting is required not only to be thin by the demand for miniaturing information processing equipments or the like in recent years but also to have high speed performance in accordance with increase of an amount of information to be processed.

As conventional contact substrates for integrated circuits, the following are exemplified. That is, one contact substrate uses a terminal contact member 35 in which a curved portion 27 is formed to give elasticity in an up-and-down direction, and a support portion 29 for a terminal is formed (FIG. 4(*a*)).

Another contact substrate includes a silicone rubber 30 in which metal thin wires 31 are buried at a high density (FIG. 4(*b*)). A third contact substrate includes a rubber sheet 32 between both surfaces of which conductive grains 33 are disposed in lines, and when the contact substrate is compressed by a spherical terminal 24 of an integrated circuit, the conductive grains 33 at a compressed portion are brought into contact with one another (FIG. 4(*c*)). A fourth contact substrate includes a terminal contact member 35 which is buried in a sheet while an end of the terminal contact member is supported by a coil spring 34 and the other end thereof protrudes from the sheet (FIG. 4(*d*)). A fifth contact substrate includes a terminal contact member 35 which is formed of a randomly wound wire of a conductive material and is buried in a sheet while both ends thereof protrude from the sheet (FIG. 4(*e*)).

However, the above-mentioned conduction assist member is used in a socket-plug type connector and especially the conduction assist member as disclosed in Japanese Utility Model Publication (Kokoku) No. 51-8710 has a problem in durability such that the tongue pieces or blade portions are damaged or abraded due to repeated use. Furthermore, the conduction assist member has a problem that it must be prepared in compliance with different standards so that it matches with sizes of connectors.

As to the contact substrates for integrated circuits, the contact substrate shown in FIG. 4(*a*) is inferior in high speed performance and poses a problem that it cannot be used for an integrated circuit socket for mounting.

The contact substrate shown in FIG. 4(*b*) can hardly be applied to an integrated circuit of the LGA type although it is superior in high speed performance.

Also, with respect to the contact substrate shown in FIG. 4(*c*), there are problems that conduction is unstable due to a fact that the conductive grains 33 in a line are not brought into sufficient contact with each other or are brought into contact with the conductive grains 33 in another line.

Further, since the contact substrate shown in FIG. 4(*d*) is required to be thick inevitably due to the structure thereof, it exhibits problems in that it exhibits inferior high speed performance and that it is not suited for mounting use.

Furthermore, the contact substrate shown in FIG. 4(*e*) poses a problem that it has diversified conduction paths and its electric characteristics become unstable.

SUMMARY OF THE INVENTION

The present invention has been made in view of these circumstances, and an object thereof is to provide a conduction assist member which can be applied to both a flat conduction surface and a curved conduction surface when it is used in a connector, which can easily cope with the difference in size of a connector and a socket when it is used in an integrated circuit socket, which is superior in high speed performance, which can be used in an integrated circuit socket for mounting and which can be easily assembled. Another object of the present invention is to provide a manufacturing method of the above conduction assist member, a connector using the conduction assist member and an integrated circuit socket using the same.

According to the present invention, there is provided a conduction assist member comprising: a sheet made of an insulating elastic material and having a number of through holes; and conduction members disposed in an inside of a part of the through holes or all the through holes, the conduction members comprising a conductive material, wherein a cut piece is fixed to said sheet at an end thereof and has two or more blades which are formed by one, two or more cuts, and wherein one or some of said two or more blades formed on each cut piece are bent toward one of two opening portions of the through hole so that ends of said blades formed on said cut pieces protrude from said opening portions on the same surface of the sheet.

In the conduction assist member of the present invention, at least one of the two or more blades may be bent toward an opening portion toward the other opening portion existing on the other surface of the sheet.

In the conduction assist member mentioned above, it is preferable that each cut piece has two blades which are formed by providing a single cut at the other end.

In the conduction assist member mentioned above two sheets each made of an insulating elastic material are laid one on top of the other and one end of the cut piece is held by the two sheets so that the cut piece is fixed to the two sheets.

In the conduction assist member described above, it is preferable that a shape of the opening portion of the through hole is circular and the diameter thereof is 0.2 to 1.2 mm. Also, it is preferable that the pitch of the through holes is 0.25 to 1.5

In the conduction assist member mentioned above, it is preferable that the conduction material is made of at least one material selected from the group consisting of beryllium copper, titanium copper, copper-nickel-tin alloy, phosphor bronze and copper-nickel-silicon alloy, and the insulating elastic material is made of rubber or resin.

Further, the present invention provides a connector in which the above conduction assist member is made to intervene between connecting elements. Still further, the present invention provides an integrated circuit socket using the above conduction assist member as a contact substrate to a terminal of an integrated circuit.

Furthermore, the present invention provides a manufacturing method of a conduction assist member having conduction members disposed in some or all through holes formed in a large number in a sheet made of an insulating elastic material. First, a plurality of through holes are formed in two films made of an insulating elastic material at locations corresponding to each other. Next, from a conductive material, a structure consisting of a number of cut pieces linked with one another and each having one, two or more cuts if formed. The structure is then laid between the two films so that each cut piece is disposed in the through hole. A sheet is then formed by bringing the two films into thermal press contact. The cut pieces are then cut from one another, and one or some of two or more blades formed by the cuts are bent toward one of two opening portions of the through hole so that ends of the blades formed on the cut pieces protrude from opening portion on the same surface of the sheet.

In the manufacturing method described above, the cut pieces may be cut by punching through the sheet, and the blades may be bent by punching through the through holes.

Moreover, the present invention provides a manufacturing method of a conduction assist member having conduction members disposed in some or all through holes formed in a large number in a sheet made of an insulating elastic material. According to this method, a cut piece is formed which has one, two or more cuts, and is made of a conductive material by etching a sheet having a layer made of a conductive material at a predetermined pitch on one surface of a film made of an insulating elastic material. The cut pieces are then covered by laminating another film made of an insulating elastic material with the film and forming a sheet by bringing the two films into thermal press contact. Through holes are then formed in the vicinities of the cut pieces. One or some of two or more blades formed by toward one of two opening portions of the through hole so that ends of the blades formed on the cut pieces protrude from the opening on the same surface of the sheet.

In the manufacturing method described above, the blades may be bent by punching through the through holes.

In the manufacturing methods described above, another or others of the blades may be bent toward a second opening portion different from the opening portion which exists in the direction where the above-mentioned blades are bent.

In the manufacturing methods described above, it is preferable that each of the cut pieces has two blades formed by a single cut.

In the manufacturing methods described above, it is preferable that a shape of the opening portion of the through hole is circular and a diameter thereof is 0.2 to 1.2 mm. It is also preferable that a pitch of the through holes is 0.25 to 1.5 mm.

In the manufacturing methods described above, it is further preferable the conductive material is made of at least one material selected from the group consisting of beryllium copper, titanium copper, copper-nickel-tin alloy, phosphor bronze and copper-nickel-silicon alloy.

DETAILED DESCRIPTION OF PREFERRED EMBODIMENT

Figure 1:
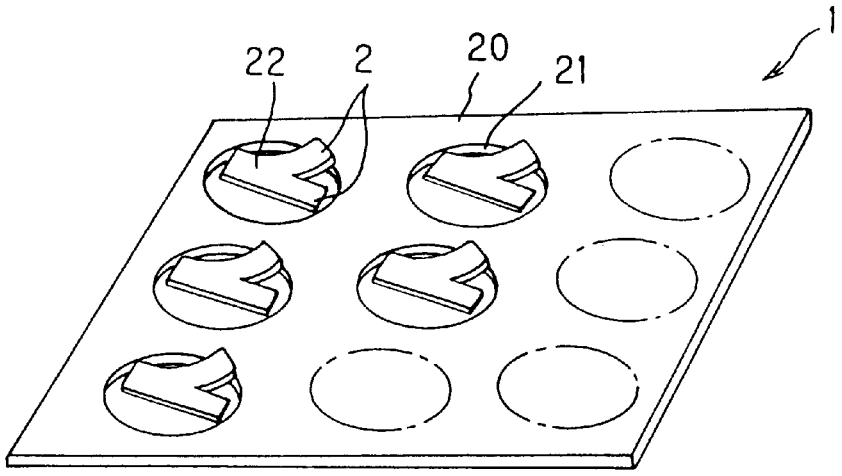
FIG. 1 is a perspective view showing an embodiment of a conduction assist member of the present invention.

A conduction assist member of the present invention is constituted, as shown in FIG. 1, in such a manner that a cut piece 22 made of a conductive material is disposed in each of through holes 21, which are provided in a large number in a sheet 20 made of an insulating elastic material while one end of the cut piece is fixed to the sheet. Each cut piece has two or more blades 2 which are formed by one, two or more cuts and one or some of the two or more blades 2 are bent toward one of two opening portions of the through hole 21 so that ends of the blades formed on the cut pieces 22 protrude from the opening portions on the same surface of the sheet 20.

Figure 2:
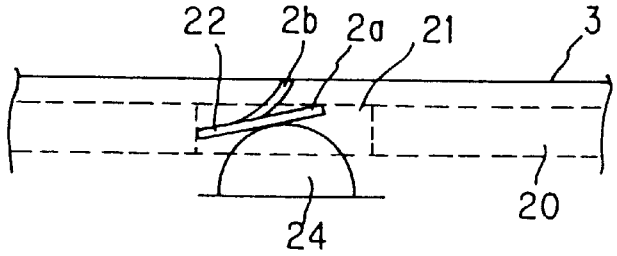
FIG. 2 is a schematic sectional view descriptive of a function of the conduction assist member of the present invention.

The conduction assist member shown in FIG. 1 is to be used as a contact substrate to a terminal of a BGA (spherical terminal) type integrated circuit and secures stable conduction since a tip of a bent blade 2*b* is compressed to a connecting element 3 existing on an opposite side of the sheet 20 when a spherical terminal 24 presses a blade 2*a* which is not bent toward the opposite side of the sheet 20 as shown in FIG. 2. Further, since one end of the cut piece 22 is fixed to the sheet 20, the cut piece 22 functions as a leaf spring which secures stable contact between the cut piece 22 and the spherical terminal 24.

Since the conduction assist member of the present invention can be extremely thin by adjusting thickness of the sheet, it offers superior in high speed performance when applied to an integrated circuit socket and is also usable as an integrated circuit socket for mounting.

Figure 3:
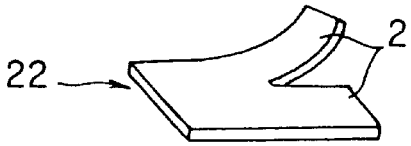
FIGS. 3(*a*) through 3(*c*) are perspective views showing manners of cut pieces composing the conduction assist member of the present invention.
Figure 3:
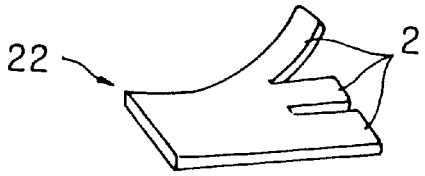
Figure 3:
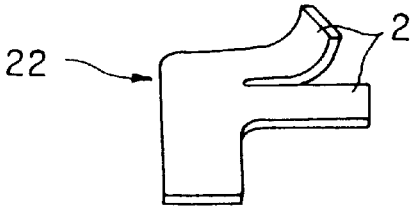
Figure 4:
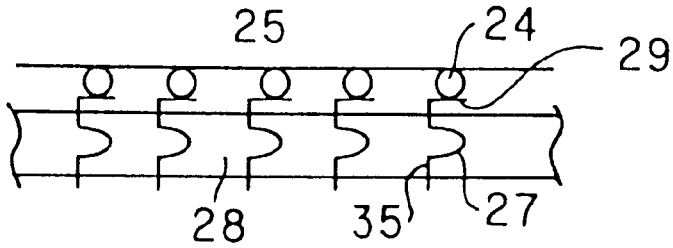
FIGS. 4(*a*) to 4(*e*) are schematic sectional views showing conventional contact substrates for an integrated circuit socket.
Figure 4:
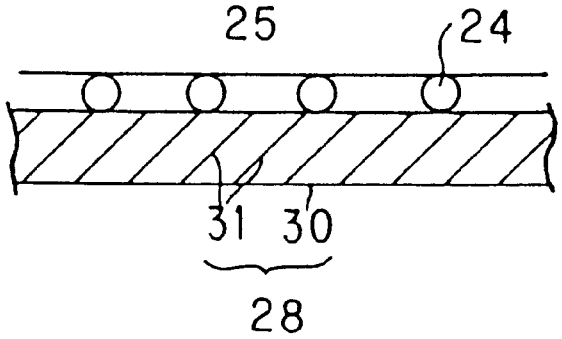
Figure 4:
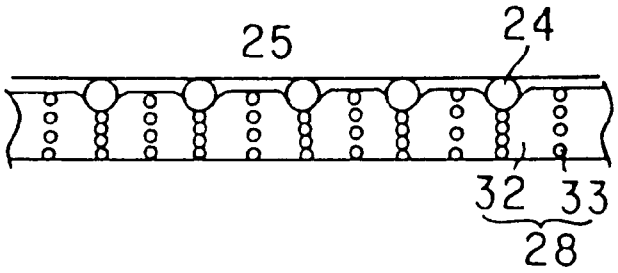
Figure 4:
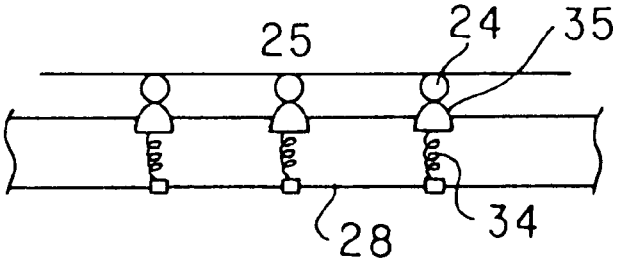
Figure 4:
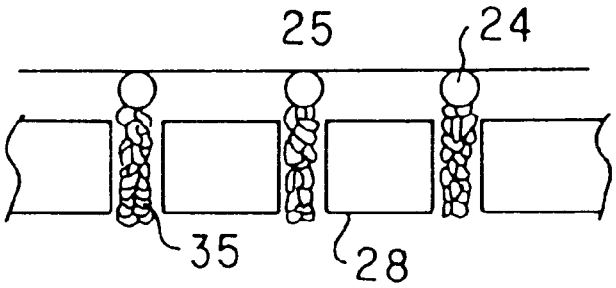

Although cut pieces such as those shown in FIGS. 3(*b*) and 3(*c*), for example, can be used since no particular restrictions are imposed on number and state of the cuts so far as two or more blades can be formed, it is preferable to use cut pieces each of which has two blades formed by a single cut as shown in FIG. 3(*a*) in light of production efficiency considerations.

Depending upon the arrangement states of terminals or the like of an integrated circuit, the cut pieces 22 may be disposed in all the through holes or some of the through holes.

Figure 7:
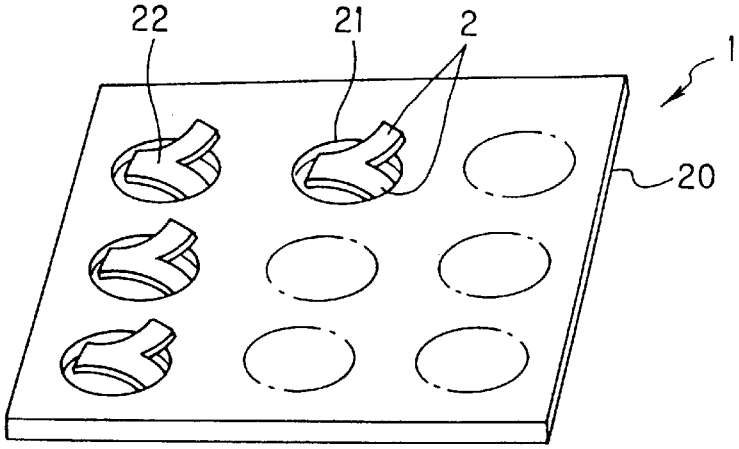
FIG. 7 is a perspective view showing another embodiment of the conduction assist member of the present invention.

When at least one of the two or more blades 2 is bent toward an opening portion which exists on one surface of the sheet 20, and at least another of the two or more blades 2 is bent toward the other opening portion which exists on the other surface of the sheet 20 as shown in FIG. 7, the conduction assist member of the present invention becomes a conduction assist member 1 which is usable as a contact substrate to a connector and an LGA (flat terminal) type integrated circuit.

When the conduction assist member 1 shown in FIG. 7 is made to intervene between connecting elements of a connector, distortion of a conduction surface is effectively absorbed by the cut pieces 22 protruding from the sheet 20 if dust or the like exists on the conduction surface, it is possible to secure certain electrical conduction. Further, since the conduction assist member of the present invention uses the insulating elastic material, it can be applied not only to a connector whose connecting elements have flat conductive surfaces but also to a connector whose connecting elements have curved conductive surfaces.

Since the conduction assist member of the present invention can be cut into a suitable piece in accordance with a specific size and shape of a conduction surface of a connector or an integrated circuit socket, it can easily cope with the difference in the size and shape. When the conduction assist member of the present invention is to be used as a contact substrate to a terminal of an integrated circuit, it is necessary that the cut pieces are insulated from one another.

Although the opening portion of the through hole may have any shape, for example, a rectangle, a triangle, a circle or an ellipse in the conduction assist member of the present invention, it is preferable to select a circle. In case where the shape of the opening portion is a circle, it is preferable that a diameter thereof is 0.2 to 1.2 mm. The reason is as follows. That is, if the diameter is less than 0.2 mm, the manufacturing is difficult, and if the diameter is larger than 1.2 mm, any benefit cannot be obtained.

It is preferable that a pitch of the through holes is 0.25 to 1.5 mm, for the following reason. That is, if the pitch is less than 0.25 mm, sufficient assembling accuracy cannot be achieved. However if the pitch is larger than 1.5 mm, there is no comparative benefit with other packages such as a PGA package and a QFP package. A distortion absorbing effect of the conduction surface is weakened, and it becomes difficult to apply the conduction assist member to a curved surface. Here, the pitch of the through holes refers to the shortest distance between a center of a through hole and a center of another through hole positioned closest the former through hole.

The conductive material used for the conduction assist member of the present invention is required to have wear resistance, flexibility, oxidation resistance, strength and the like in addition to the conductivity. Although the conductive material can be made of at least one material selected from the group consisting of beryllium copper, titanium copper, copper-nickel-tin alloy, phosphor bronze and copper-nickel-silicon alloy, it is preferable to use beryllium copper. That is, when the beryllium copper is used as the conductive material, it is possible to impart fatigue characteristics and heat resistance to the conduction assist member of the present invention, so that it also becomes possible to use the conduction assist member as a contact substrate of an integrated circuit inspection instrument for a burn-in test. Accordingly, the beryllium copper or the materials having properties equivalent to the beryllium copper are most preferably used as the conductive material in the present invention.

Although the conductivity of beryllium copper depends on its composition, it is 20 to 60% of that of pure copper so that beryllium has sufficient conductivity. Further, Vickers hardness of beryllium copper is 250 to 400 while that of copper is 80 to 100, which indicates that beryllium copper offers superior wear resistance.

As a composition of beryllium copper to be used as the conductive material constituting the conduction assist member of the present invention, it is preferable that the beryllium copper contains, in a total amount with copper, 0.2 to 3% by weight of beryllium, 0.1 to 3% by weight of nickel and cobalt in combination, and 0.05 to 3% by weight of at least one element in combination selected from a group consisting of aluminum, silicon, iron, titanium, tin, manganese, zinc and indium, it is more preferable that the beryllium copper contains 1.6 to 2% by weight of beryllium, 0.2 to 1% by weight of nickel and cobalt in combination, and 0.05 to 1% by weight of at least one element selected from the group consisting of aluminum, silicon, iron, titanium, tin, magnesium, manganese, zinc and indium, and it is still more preferable that the beryllium copper contains 1.6 to 2% by weight of beryllium, 0.2 to 0.6% by weight of nickel and cobalt in combination, and 0.05 to 1% by weight of at least one element in combination selected from the group consisting of aluminum, silicon, iron, titanium, tin, magnesium, manganese, zinc and indium.

If the content of beryllium is more than 3% by weight, the conductivity is lowered. If it is less than 0.2% by weight, the conductivity is lowered so that it is not preferable to make the content more than 3% by weight. Even if the content of beryllium is more than 2% by weight, the improvement of strength comparable to the increase of the content is uneconomical. On the other hand, if the content is less than 0.2% by weight, the strength of the cut piece becomes insufficient. If the total amount of nickel and cobalt is more than 3% by weight, the conductivity is lowered. If it is less than 0.2% by weight, the improvement of strength by addition of beryllium is suppressed, so that the amount of addition of beryllium must be increased. Also, if the total amount of aluminum and other elements is more than 3% by weight, the conductivity is lowered, and if the total amount is less than 0.05% by weight, the strength especially at a high temperature becomes insufficient.

It is preferable that thickness of the cut piece used as the conduction member is 0.01 to 0.1 mm, and is more preferable that the thickness is 0.02 to 0.05 mm, for the following reason. That is, if the thickness is less than 0.01 mm, the strength of the cut piece is so low that it is difficult to obtain a suitable contact load. If the thickness is more than 0.1 mm, the strength of the cut piece is so high that a terminal of an integrated circuit cannot strongly compress the cut piece to a connecting element existing on the opposite side of the sheet, and it is difficult to secure stable conduction.

It is preferable that thickness of the sheet constituting the conduction assist member of the present invention is 0.06 to 0.66 mm, and is more preferable that the thickness is 0.1 to 0.2 mm, for the following reason. That is, if the thickness is smaller than 0.06 mm, the mechanical strength becomes low so that durability becomes problematic. On the other hand, if the thickness is larger than 1.0 mm, it becomes difficult to make the sheet intervene between the connecting elements of a connector.

The elastic material constituting the conduction assist member is required to have heat resistance, weatherability and the like. Rubber such as silicone rubber and synthetic rubber, or resin such as polymer, polyimide, engineering resin may be used. Especially, polyimide is preferably used.

The conduction assist member of the present invention is used by being disposed between connecting elements constituting a connector in such a manner that one surface of the conduction assist member is brought into contact with a conduction surface of one of the connecting elements and the other surface thereof is brought into contact with a conduction surface of the other of the connecting elements. When the conduction surfaces of the connecting elements are brought into press contact with the conduction assist member by a fixing tool or the like of the connector, the conduction becomes certain. Also, the conduction assist member of the present invention may be bonded to the conduction surface of one of the connecting elements of the connector so that it is used as a part of the connector.

The conduction assist member of the present invention may be used as a member constituting an integrated circuit socket, and as a contact substrate to a terminal of an integrated circuit. The integrated circuit socket includes also an inspection instrument for inspecting the characteristics of an integrated circuit.

Figure 5:
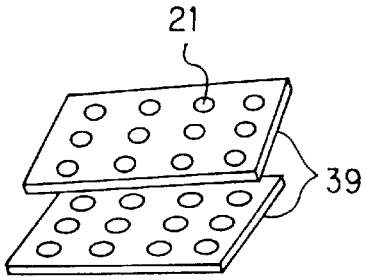
FIGS. 5(*a*) to 5(*d*) are schematic views showing an example of manufacturing method of the conduction assist member of the present invention.
Figure 5:
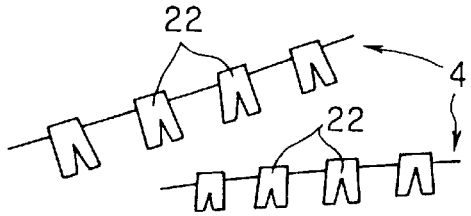
Figure 5:
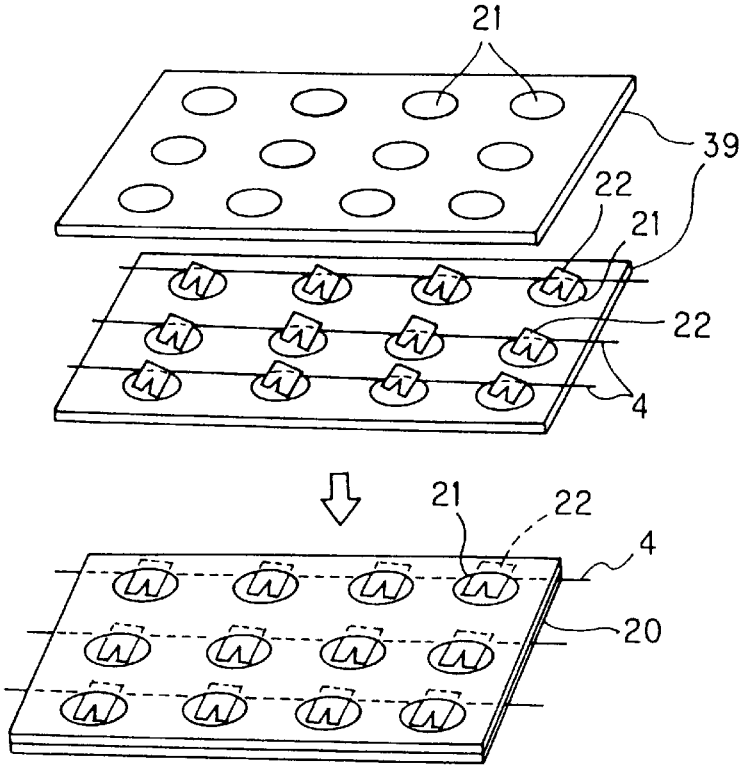
Figure 5:
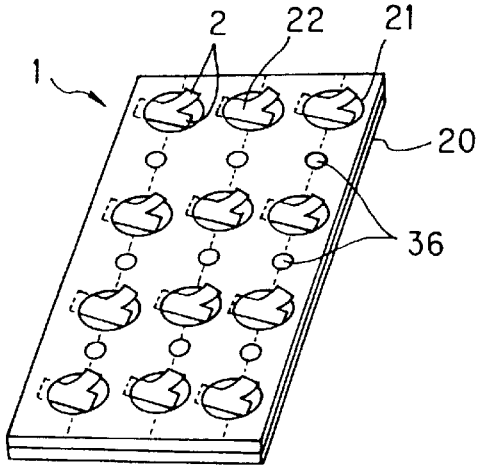

Out of the conduction assist members of the present invention, the conduction assist member shown in FIG. 1 wherein the cut pieces are bent only in one direction is manufactured through a first step to form a plurality of through holes 21 at corresponding locations in two films 39 made of an insulating elastic material (FIG. 5(*a*)), a second step to form a structure 4 consisting of a number of cut pieces 22 each of which has one, two or more cuts and which are linked with one another from a conductive material (FIG. 5(*b*)), a third step to make the structure 4 intervene between the two films 39 so that each cut piece 22 is positioned in the through hole 21 and bring the two films 39 into press contact so as to form a sheet (FIG. 5(*c*)), and a fourth step to cut the cut pieces 22 from one another and bend one or some of two or more blades formed by the cuts toward one of two opening portions of the through hole whichever is located on a surface of the sheet having other opening portions so that ends of the blades protrude from the opening portion (FIG. 5(*d*)).

Although a punch, laser or the like may be used as a means for cutting the cut pieces from one another, it is preferable that punching is made on the sheet as shown in FIG. 5(*d*). Further, as a means to bend the blades, it is preferable that punching is made on the through holes. Form a viewpoint of improvement of production efficiency, it is preferable that the cutting of the cut pieces and bending of the blades are carried out at the same time with a punching apparatus which has two punching members. Punching may be carried out collectively or progressively.

Figure 6:
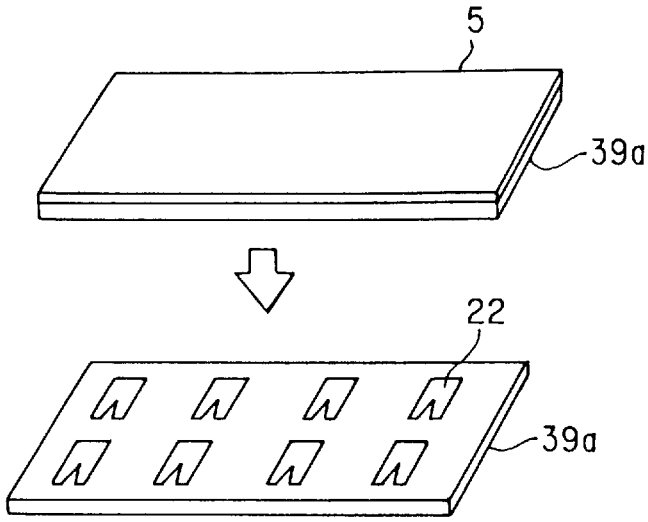
FIGS. 6(*a*) to 6(*d*) are schematic views showing another example of manufacturing method of the conduction assist member of the present invention.
Figure 6:
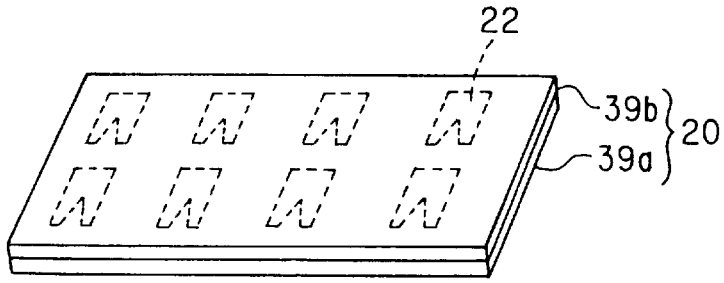
Figure 6:
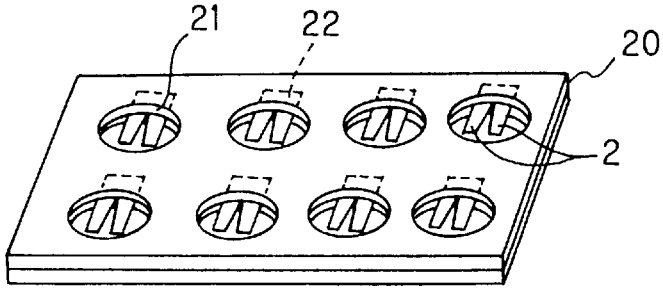
Figure 6:
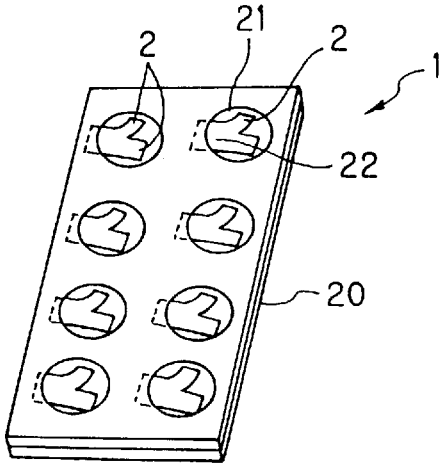

The conduction assist member shown in FIG. 1 wherein the cut pieces are bent only in one direction can be manufactured also through a first step to etch a sheet having a layer 5 made of a conductive material so as to form cut pieces 22 each of which has one, two or more cuts and is made of a conductive material at a predetermined pitch on one surface of a film 39*a* made of an insulating elastic material (FIG. 6(*a*)), a second step to laminate another film 39*b* made of an insulating elastic material with the film 39*a* so as to cover the cut pieces 22 and bring the two films 39 into press contact so as to form a sheet (FIG. 6(*b*)), a third step to remove the films in the vicinities of the cut pieces 22 with a laser so as to form through holes 21 (FIG. 6(*c*)), and a fourth step to bend one or some of two or more blades 2 formed by the cuts toward one of two opening portions of the through hole 21 whichever is located on one surface of the sheet having other opening portions so as to protrude ends of the blades 2 from the opening portions (FIG. 6(*d*)). It is preferable that the through holes are punched for bending the blades 2.

Further, the conduction assist member shown in FIG. 7 wherein each of the cut pieces is bent in both directions is manufactured by bending another or other of the blades 2 toward the other opening portion which is different from the opening portion existing in the direction where the one or some of the blade 2 are bent at the fourth step of the manufacturing method shown in FIGS. 5(*a*) to 5(*d*) or FIGS. 6(*a*) to 6(*d*).

Figure 8:
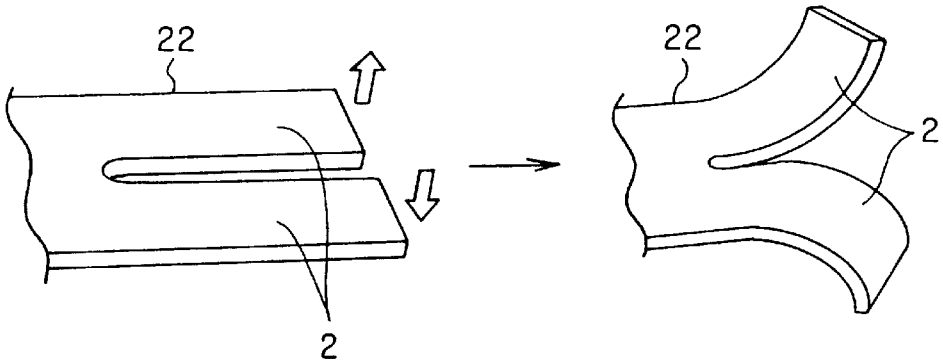
FIG. 8 is a perspective view descriptive of two-directional punching.

From a viewpoint of improvement in a production efficiency, it is preferable that the blade 2 is bent in two directions at the same time by two-directional punching as shown in FIG. 8.

In the manufacturing method of the conduction assist member of the present invention, the through holes are formed with a punch, a drill, a laser or the like. Further, it is preferable to bond the two films by thermal press contact although they can be bonded by the normal method.

The present invention will be described in more detail by using a specific embodiment shown in the drawings. However, the present invention is not limited to the embodiment.

EXAMPLE

A conduction assist member in which cut pieces are bent in two directions as shown in FIG. 7 was manufactured by a method described below.

By etching a sheet having a layer 5 made of beryllium copper, cut pieces 22 each having a cut were formed at a pitch of 0.5 mm on one surface of a polyimide film 39*a* with a length of 50 mm, a width of 50 mm and a thickness of 0.125 mm as shown in FIG. 6(*a*).

Next, the cut pieces 22 were covered by laminating another film 39*b* which is made of polyimide and has the same size with the film 39*a* as shown in FIG. 6(*b*) and a sheet 20 was formed by bringing the two films into thermal press contact.

Next, as shown in FIG. 6(*c*), through holes 21 which had a diameter of 0.5 mm were formed at a pitch of 0.5 mm by removing the film in the vicinities of the cut pieces 22 with a laser.

Finally, punching was made to each through hole 21 in two directions so that two blades 2 formed on each cut piece 22 were bent in directions opposite to each other as shown in FIG. 8.

As described above, the conduction assist member of the present invention is constituted in such a manner that a cut piece made of a conductive material is disposed in each of through holes which are disposed in a large number in a sheet made of an insulating elastic material while one end of the cut piece is fixed to the sheet. Further, the cut piece has two or more blades formed by one, two or more cuts, and one or some of the two or more blades are bent toward one of two opening portions of the through hole whichever is located on one surface of the sheet having other opening portions so that ends of the blades protrude from the opening portion.

Accordingly, when the conduction assist member is used as a contact substrate to a terminal of a BGA (spherical terminal) type integrated circuit, the spherical terminal presses the blades which are not bent to an opposite side of the sheet so that the tips of the bent blades are compressed to connecting elements existing on the opposite side, thereby securing stable conduction. Further, since one end of the cut piece is fixed to the sheet, the cut piece functions as a leaf spring which secures stable contact between the cut piece and the spherical terminal.

When at least one of the two or more blades is bent toward an opening portion existing on one surface of the sheet and at least another of the two or more blades is bent toward an opening portion existing on the other surface of the sheet, the conduction assist member can be used as a connector and as a contact substrate to an LGA (flat terminal) type integrated circuit. In this case, the cut piece can effectively absorb a distortion on a conduction surface of a connecting element of the connector and also secure stable electrical conduction even if dust or the like exists on the conduction surface. Further, since the conduction assist member uses an insulating elastic material, it can be applied not only to a connector whose connecting element has a flat conduction surface, but also to a connector whose connecting element has a curved conduction surface.

Since the conduction assist member of the present invention uses an elastic material, it is possible to cut the material into a suitable piece in accordance with the size and shape of a conduction surface of a connector or an integrated circuit socket, and it is possible to easily accommodates a difference in the size and shape.

Further, since the conduction assist member of the present invention is thin it offers superior in high speed performance, can be applied to an integrated circuit socket for mounting.

What is claimed is:

1. A conduction assist member comprising:

first and second sheets of insulating elastic material laminated one on top of the other;

a plurality of laterally spaced through holes passing through said first and second sheets;

a plurality of conduction members, each comprising a base part having a first end and an opposed second end and at least two blades originating in the same plane as said base part and extending in the same extension direction in substantial juxtaposition from said first end of said base part, wherein said second end of said base part is sandwiched between said first and second sheets to secure said conduction member to said sheets, and said blades are disposed in a respective through hole passing through said first and second sheets, at least one of said blades being bent away from a plane in which said base part lies, so as to protrude said at least one of said blades beyond an outer surface of at least one of said first and second sheets.

2. The conduction assist member as claimed in claim 1, wherein at least one blade of each conduction member is arranged substantially parallel to a plane of said sheet.

3. A conduction assist member as claimed in claim 1, wherein two blades are formed by providing a single cut in the end of each conduction member.

4. A conduction assist member as claimed in claim 1, wherein the opening of each through hole has a circular shape and a diameter between 0.2 to 1.2 mm.

5. A conduction assist member as claimed in claim 1, wherein a pitch of said through holes is 0.25 to 1.5 mm.

6. A conduction assist member as claimed in claim 1, wherein the insulating elastic material comprises rubber or resin.

7. A conduction assist member as claimed in claim 1, wherein the other of said blades is bent in a direction opposite to that of said at least one of said blades.

8. An integrated circuit socket, wherein the conduction assist member as claimed in claim 1 is used as a contact substrate for a terminal of an integrated circuit.

9. A connector comprising:

a conduction assist member adapted to be interposed between connecting members, said conduction assist member comprising:

first and second sheets of insulating elastic material laminated one on top of the other;

a plurality of laterally spaced through holes passing through said first and second sheets; and a plurality of conduction members, each comprising a base part having a first end and an opposed second end and at least two blades originating in the same plane as said base part and extending in the same extension direction in substantial juxtaposition from said first end of said base part, wherein said second end of said base part is sandwiched between said first and second sheets to secure said conduction member to said sheets, and said blades are disposed in a respective through hole passing through said first and second sheets, at least one of said blades being bent away from a plane in which said base part lies, so as to protrude said at least one of said blades beyond an outer surface of at least one of said first and second sheets.

10. A conduction assist member as claimed in claim 1, wherein terminal ends of said blades are disconnected from one another.

11. A conduction assist member as claimed in claim 9, wherein terminal ends of said blades are disconnected from one another.

* * * * *